US006305874B1

(12) United States Patent
Custers et al.

(10) Patent No.: US 6,305,874 B1
(45) Date of Patent: Oct. 23, 2001

(54) ROAD-MARKING COMPLEX AND SYSTEM FOR MARKING ROADS

(75) Inventors: Adrianus C. W. Custers; Pieter W. C. Provo Kluit; Jacob C. P. Den Dulk; Gabrielle J. B. M. Meekes; Wanda S. Kruijt; Lucas L. D. Van Der Poel; Franciscus G. P. Sools; Constance J. E. Saalberg-Seppen, all of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/428,769

(22) Filed: Oct. 28, 1999

(30) Foreign Application Priority Data

May 20, 1999 (EP) ..... 99201583
Jul. 19, 1999 (EP) ..... 99202378

(51) Int. Cl.[7] ..... E01F 9/16; E01F 9/053

(52) U.S. Cl. ..... 404/9; 404/12; 359/551; 359/552; 359/547

(58) Field of Search ..... 404/9, 11, 12, 404/14, 16, 22, 23; 359/551, 552, 547

(56) References Cited

U.S. PATENT DOCUMENTS

| | | | | |
|---|---|---|---|---|
| 3,877,785 | * | 4/1975 | Schaefer | 359/551 |
| 3,879,148 | * | 4/1975 | Eigenmann | 404/11 |
| 3,920,346 | * | 11/1975 | Wyckoff | 404/14 |
| 3,963,362 | * | 6/1976 | Hollis | 359/551 |
| 3,996,556 | * | 12/1976 | Eigenmann | 359/551 |
| 4,080,085 | * | 3/1978 | Dickson | 404/14 |
| 4,123,140 | * | 10/1978 | Ryan et al. | 404/12 |
| 4,232,979 | * | 11/1980 | Johnson, Jr. et al. | 404/16 |
| 4,234,265 | * | 11/1980 | Otis | 404/16 |
| 4,236,788 | * | 12/1980 | Wyckoff | 359/551 |
| 4,284,365 | * | 8/1981 | Rabinow | 404/9 |
| 4,395,155 | * | 7/1983 | Bartolotti et al. | 404/9 |
| 4,875,799 | * | 10/1989 | Harrison | 404/12 |
| 4,925,335 | * | 5/1990 | Eigenmann | 404/12 |
| 4,993,868 | * | 2/1991 | Eigenmann | 404/12 |
| 5,006,010 | * | 4/1991 | Duckett | 404/12 |
| 5,013,181 | * | 5/1991 | Harrison | 404/12 |
| 5,450,236 | * | 9/1995 | Odemark | 404/14 |
| 5,683,746 | * | 11/1997 | Hedblom et al. | 404/14 |
| 5,684,490 | * | 11/1997 | Young et al. | 404/14 |
| 5,822,119 | * | 10/1998 | Rasmussen et al. | 404/12 |
| 5,822,120 | * | 10/1998 | Palazzatto et al. | 404/12 |
| 5,825,544 | * | 10/1998 | Poisson | 404/14 |
| 5,873,674 | * | 2/1999 | Hohl | 404/9 |
| 5,928,761 | * | 7/1999 | Hedblom et al. | 404/14 |

FOREIGN PATENT DOCUMENTS

| | | | |
|---|---|---|---|
| 8704230 | 7/1987 | (WO) | F12V/8/00 |

* cited by examiner

*Primary Examiner*—Robert E. Pezzuto
*Assistant Examiner*—Alexandra K. Pechhold
(74) *Attorney, Agent, or Firm*—Dicran Halajian

(57) ABSTRACT

A first road marking unit with a first base plate is provided with a first light source, and a second road-marking unit with a second base plate is provided with a second light source. A view angle of $0.1 \leqq \alpha \leqq 8°$ is formed between an interconnecting line, which interconnects the first and the second light sources, and an intersecting line which intersects the interconnecting line. In a view section where the view angle is $0.1 \leqq \alpha \leqq 8°$, light beams originating from the first and the second light sources demonstrate a uniform overlap in the view section at a distance $a \geqq 40$ m from the first light source. Preferably, the distance d between the first light source and the second light source lies in the range from $10 \leqq d \leqq 25$ cm. The first and the second base plate of the road-marking units are integrated so as to form a base module.

20 Claims, 9 Drawing Sheets

ROAD-MARKING COMPLEX AND SYSTEM FOR MARKING ROADS

BACKGROUND OF THE INVENTION

The invention relates to a road-marking complex comprising at least a first and a second road-marking unit.

The invention further relates to a road surface provided with a road-marking complex.

The invention also relates to a system for marking roads comprising one or more road-marking complexes, a control system for the road-marking complexes and means for coupling the road-marking complexes to the control system.

Such road-marking complexes are used in traffic-control systems for marking traffic routes for vehicles, such as roads for cars and other road users, and runways for aircraft. One of the methods used by traffic planners in their attempts to reduce traffic jams is a so-called "tidal flow system". In such a dynamic system, the direction of the traffic of multi-lane roads is changed at one or more lanes in accordance with the direction of the main flow of traffic. In an alternative embodiment, the number of lanes available to traffic moving in a specific direction is increased or reduced, dependent upon the amount of traffic. A problem with these methods resides in the indication in a flexible manner of the direction of the desired flow of traffic for a specific lane, or in changing the arrangement of the traffic route in a flexible manner. Known means for indicating the desirable direction of the flow of traffic include signaling lights beside or above the traffic route.

Said road-marking complexes cannot only be used as dynamic road-marking complexes; they can also be given static applications. Static applications of road-marking complexes include marking parts of traffic routes (for example straight parts or bends) so as to give guidance to the direction of the traffic under certain weather conditions, for example during fog, rain, black ice, etc., and/or under certain light conditions, such as daylight, twilight, a low position of the sun, night, etc.

Road-marking complexes can be provided in a road surface of the traffic route but also beside and/or above the traffic route, for example on a crash barrier at the side of the traffic route.

WO 87/04230 describes a system for defining and controlling traffic routes, wherein road-marking units emitting visible light are provided in the road surface at a distance from units generating said light. In addition, means are provided for transmitting heat to the road-marking units to make sure that these road-marking units function properly under different weather conditions.

A drawback of the known road-marking complex is that it is impossible to emit the light in such a way that the road user observes lines.

SUMMARY OF THE INVENTION

According to the invention, the first road-marking unit comprises a first base plate which is provided with at least a first light source, the second road-marking unit comprises a second base plate which is provided with at least a second light source, in a plane enclosing an angle of 0.1 to 8° with a line which connects the first light source to the second light source, light beams originating from the first and the second light source demonstrate a uniform overlap in this plane, at a distance of at least 40 meters from the first light source.

In the description of the current invention, a "light source" is defined as a unit which emits (visible) light, the origin of the light not necessarily being situated at the location of the light source. For example, light emitted by the light source may also be generated at a distant location and may be transferred by means of light guides, such as optical fibers, from a so-called light generator to the light source. The term "light source" generally does not refer to light generated by reflection of light, in particular light emitted by a vehicle which is reflected at the location of the "light source". Furthermore, in this description, light beams which demonstrate a "uniform overlap" are to be taken to mean light beams which cannot be distinguished by the human eye under the above-mentioned conditions.

In accordance with the invention a road user, for example a motorist or a truck driver who, from his vehicle, looks ahead at the traffic on the road and the markings in the road surface, observes at a distance equal to or above 40 m that the light beams originating from the first light source in the first road-marking unit and from the second light source in the second road-marking unit demonstrate a uniform overlap. Light originating from the first and the second light source is perceived as an imaginary "white" line under these conditions. This is the case particularly if the light originates from a plurality of such light sources, for example a suitably chosen (two-dimensional) arrangement of light sources. A particularly suitable example of such an arrangement is a two-dimensional array of 6×4 light sources, wherein six light sources are arranged one behind the other in the surface of the road, in the observer's direction of view, and four light sources are arranged next to one another in the surface of the road in a direction transverse to the observer's direction of view. Said six light sources situated in the extension of the observation field of the road user are provided, in accordance with the inventive measure, in such a manner that, given the view angle of the observer, light beams originating from said light sources demonstrate a uniform overlap at a distance equal to or above 40 m. Said four light sources, which extend transversely to the direction of view of the road user, are so closely spaced that the human eye cannot distinguish these four light sources at a distance equal to or greater than 40 m. An observer situated at a distance greater than or equal to 40 m from the whole arrangement of 6×4 light beams originating from said light sources, the angle of view of the observer ranging between 0.1 and 8°, perceives said arrangement of light beams as an imaginary line in the road surface. The present invention can particularly effectively be used when the distance a between the road user and the first light source ranges from $40 \leqq a \leqq 100$ m.

Preferably, a distance d between the first and the second light source lies in the range from $10 \leqq d \leqq 25$ cm. In this manner, a good display of the imaginary line is obtained by means of a limited number of light sources. If the distance d is smaller than 10 cm, a large number of light sources are necessary to achieve the desired effect. For distances above 25 cm, the coherence of the light sources is such that they are no longer perceived as forming a coherent object (imaginary line) by the road user. Particularly suitable is a distance d in the range between 15 and 20 cm.

An embodiment of the road-marking complex is characterized in accordance with the invention in that the first and the second base plate of the road-marking units form a solidly constructed base module. Such base modules can be readily produced and can be bodily provided in the road surface, preferably when the road is under construction. In addition, the electric conductors or the light guides, which generate the light for the light sources, can be readily provided on or in a side of the base module facing away from the light source. The use of a base module has the further advantage that it is not necessary to provide, for each road-marking unit, a connection to the (light) generator underneath or in the road surface; instead, one connection to the (light) generator is provided for each base module comprising a number of road-marking units.

In a preferred embodiment of the road-marking complex in accordance with the invention, the base module is at least partly provided with means for increasing the skid resistance of the base module. Very advantageously, said means comprise a pattern of bumps. A high skid resistance is desirable in order to provide for under all kinds of weather conditions, a good contact between the wheels and the road surface provided with the base module, thus precluding skidding. Polyurethane is a very suitable material for the manufacture of the base module and the base plates.

In an alternative, favorable embodiment of the road-marking complex in accordance with the invention, the base module can suitably be built into a road surface. If the base module is largely provided in the road surface, said base module is effectively protected against wear. Since only a relatively small part of the base module is situated at the surface of the road, the material of the base module and said surface do not have to meet the anti-skid requirements imposed on a road surface. In a further alternative embodiment of the road-marking complex, the base module is manufactured from a plastics material in combination with or/and filled with stones and/or minerals.

To protect the light sources, they are preferably recessed in the base plates and in the base module.

For the light source use can be made of an opto-electronic element whose luminous flux amounts to at least 5 lm during operation. Opto-electronic elements, also referred to as electro-optical elements, such as electro-luminescent elements, for example light-emitting diodes, can very suitably be used as the light source. The opto-electronic element is preferably mounted in the road-marking unit. A relatively high luminous flux is necessary to generate enough light also at ambient light, for example sunlight or light originating from headlights, so that the light beam can be sufficiently brightly observed from a distance.

As an alternative light source for use in the road-marking complex, use can very suitably be made of an end portion of an optical fiber. This has the advantage that the light emitted by the light source is generated in a light generator at a distance from the road-marking unit and transferred from the light generator to the light source by means of optical fibers. The light generator may comprise a light source accommodated in the housing, for example a semiconductor light source such as an opto-electronic element, or a discharge lamp, such as a mercury discharge lamp. In an attractive variant of this embodiment, the light generator comprises a first end of at least one light guide, which light guide is optically coupled, at a second, opposite end, to the light source in the road-marking unit. The light source in the light generator is preferably arranged at a distance from the road-marking unit so that said light source can be readily replaced, for example at the end of its service life. A further advantage of employing optical light guides is that the use of optical fibers results in a very efficient use of light, which entails no, or at least very little, luminous pollution. Luminous pollution is to be taken to mean the loss of light caused by the fact that areas are illuminated where illumination is not necessary and/or undesirable. An advantage of the use of optical light guides with respect to the use of opto-electronic elements is that in the case of optical fibers, no electric voltages and currents have to be fed to the light source via the road surface. This results in increased traffic safety. Also in the case of accidents and other calamities, the risk of an electric voltage flashover or a short-circuit, which might cause an undesirable explosion, is precluded.

In an attractive, alternative embodiment of the road-marking complex in accordance with the invention, the light generator comprises a housing which accommodates a light source as well as an optical system for directing the radiation to be generated by the light source, said light source comprising a plurality of opto-electronic elements, and said light generator being provided with control electronics for operating the opto-electronic elements. Preferably, the optical system comprises a collimator lens with, optionally, a number of sub-lenses, the optical axis of each of the sub-lenses coinciding with the optical axis of one of the opto-electronic elements, and the optical system also comprises a focusing lens. The focusing lens is preferably embodied so as to be a (positive) Fresnel lens. Preferably, the opto-electronic elements comprise light-emitting diodes (LEDs), the luminous flux of which amounts to at least 5 lm during operation. The advantage of using a light generator based on opto-electronic elements is that the housing of the light generator is completely closed. As a result of the long service life of the opto-electronic elements, the light source does not have to be replaced during the service life of the light generator. This favorable property enables the light generator to form part of the base module, so that the length of the necessary light guides can be reduced substantially. A further advantage of a light generator on the basis of opto-electronic elements is that such a light generator has a high resistance to shocks. Furthermore, the control electronics enables the light to be dimmed or change color in a simple manner, for example, by switching on or off specific opto-electronic elements. In addition, a light generator on the basis of opto-electronic elements has a high luminous efficacy.

The above-mentioned application of a road-marking complex comprising a light generator on the basis of opto-electronic elements, such as LEDs, can also be considered to constitute a separate invention.

The invention further relates to a road-marking system which is provided with one or more road-marking complexes in accordance with the invention, with a control system for the road-marking complexes, and with means for coupling the road-marking complexes to the control system. The means for coupling the one or more road-marking complexes to the control system may be embodied so as to be a cable for guiding electrical or optical signals. In a variant, the means for coupling are embodied so as to be a wireless connection by means of an emitter/receiver pair, wherein the emitter sends control signals from the control system to a receiver incorporated in the road-marking complex.

These and other aspects of the invention will be apparent from and elucidated with reference to the embodiments described hereinafter.

BRIEF DESCRIPTION OF THE DRAWINGS

The Figures are purely schematic and not drawn to scale. Particularly for clarity, some dimensions are exaggerated strongly. In the Figures, like reference numerals refer to like parts whenever possible.

DETAILED DESCRIPTION OF THE PREFERRED EMBODIMENTS

Figure 1:
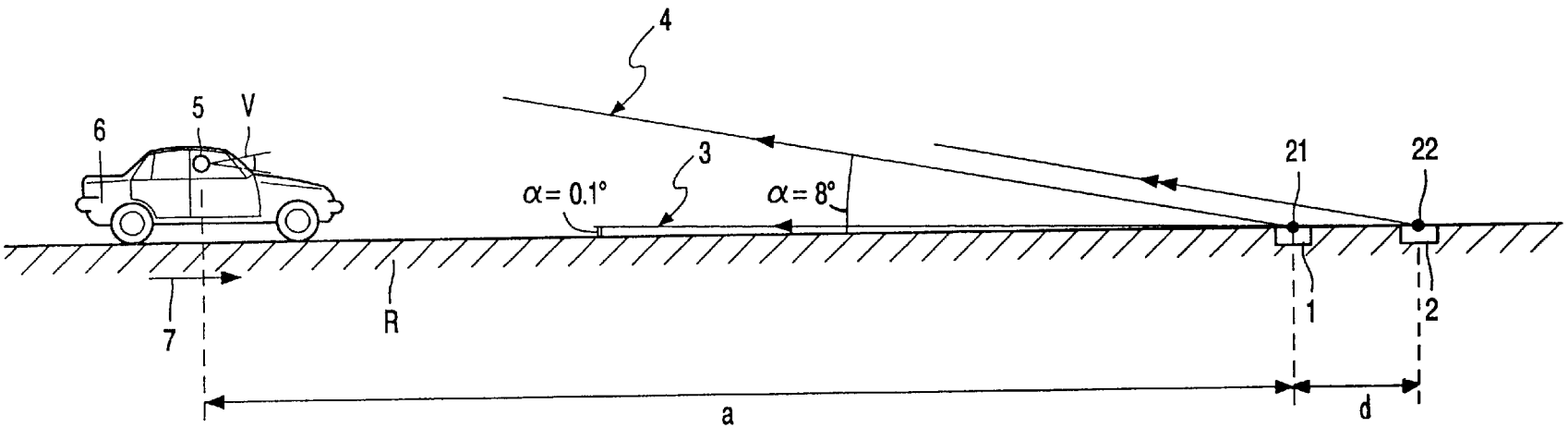
FIG. 1 is a cross-sectional view of a road-marking complex in accordance with the invention.
Figure 2:
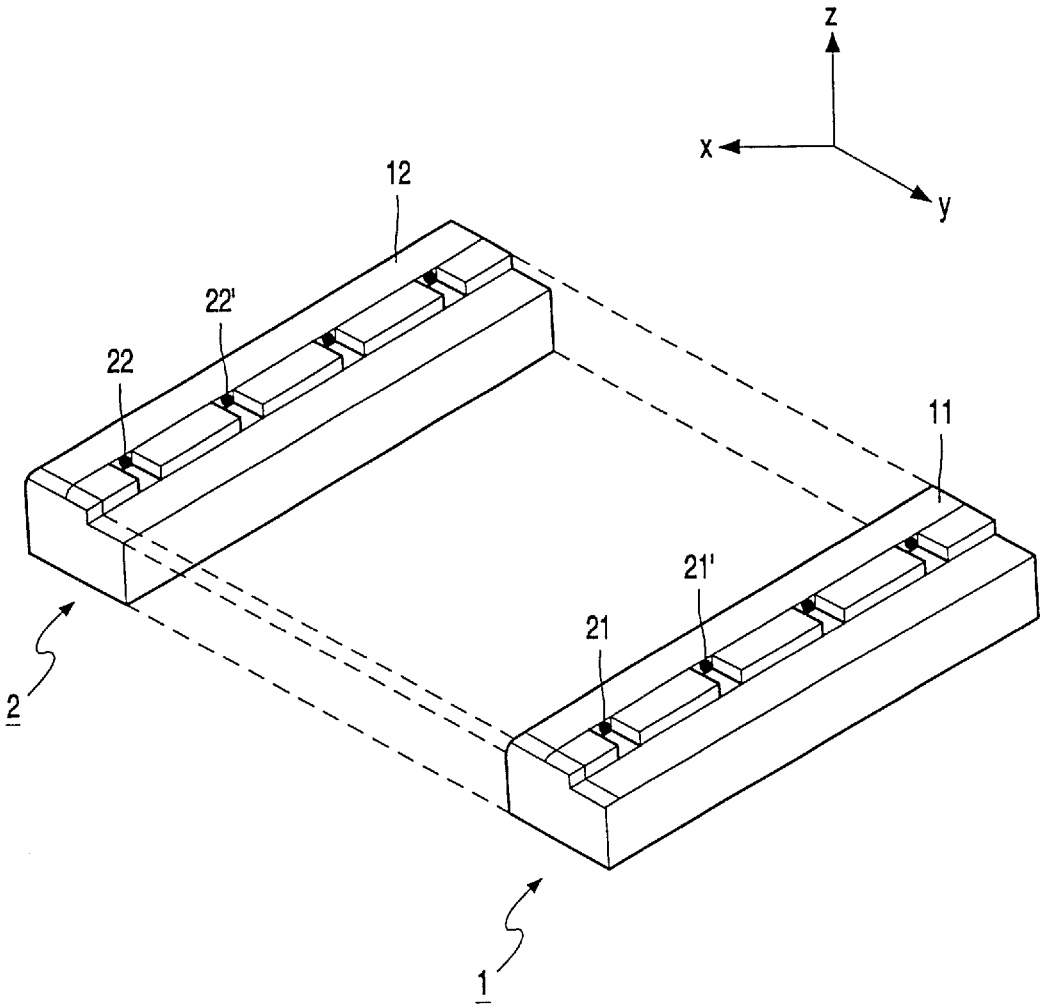
FIG. 2 is a perspective view of a first embodiment of the road-marking complex in accordance with the invention.

FIG. 1 is a very schematic, cross-sectional view of a road-marking complex in accordance with the invention. Said road-marking complex comprises a first road-marking unit 1 and a second road-marking unit 2, which are both arranged in a road surface R. In accordance with the first embodiment of the road-marking complex in accordance with the invention, as shown in FIG. 2, each of the road-marking units 1, 2 is composed of a base plate 11, 12, which are each provided with at least one light source, in this example four first sources 21, 21' in the first base plate 11, and four second light sources 22, 22' in the second base plate 12. To protect the light sources from damage, the first light sources 21, 21' are recessed in the first base plate 11, and the second light sources 22, 22' are recessed in the second base plate 12 (see FIG. 2). In FIG. 2, a co-ordinate system is shown for orientation purposes.

A plane which includes an angle $\alpha$ with the first light source 21 is represented, in the cross-sectional view of FIG. 1, by means of a line 3, 4, whereby $\alpha$=0.1° for the line referenced 3, and $\alpha$=8° for the line referenced 4. An imaginary observer 5 having a field of view V, which is situated in a vehicle 6 moving in a direction 7, is situated at distance a over the first light source 1 in the situation shown in FIG. 1, where the distance a≧40 m. In accordance with the invention, light beams emitted by the first and the second light source 21, 22 cannot be distinguished with the human eye having a field of view V. In other words, light beams emitted by the first and the second light source 21, 22 demonstrate a uniform overlap in the plane which includes an angle ($\alpha$) of 0.1 to 8° with a line connecting the first light source 21 to the second light source 22, the distance a being ≧40 m. In other words, light emitted by the first and the second light source 21, 22 is perceived as an imaginary line under the above-mentioned conditions. Preferably, the distance a between the observer 5 and the first light source 21 lies in the range from 40≦a ≦100 m.

By way of example, the eye of a driver of a passenger car 6 is situated approximately one meter above the surface of the road, or the eye of a truck driver is situated approximately 3 meters above the surface of the road. At a distance of, for example, 50 m from their vehicles, the driver of the car looks at the surface of the road R at a view angle of arc tan (1/50)=1.2°, and the truck driver looks at the surface of the road at a view angle of arc tan (3/50)=3.4°. These observers see that the light beams originating from the first and the second light source 21, 21' demonstrate a uniform overlap at said distance.

In a particularly suitable embodiment of the road-marking complex in accordance with the invention, 1≦$\alpha$≦4°.

Figure 3A:
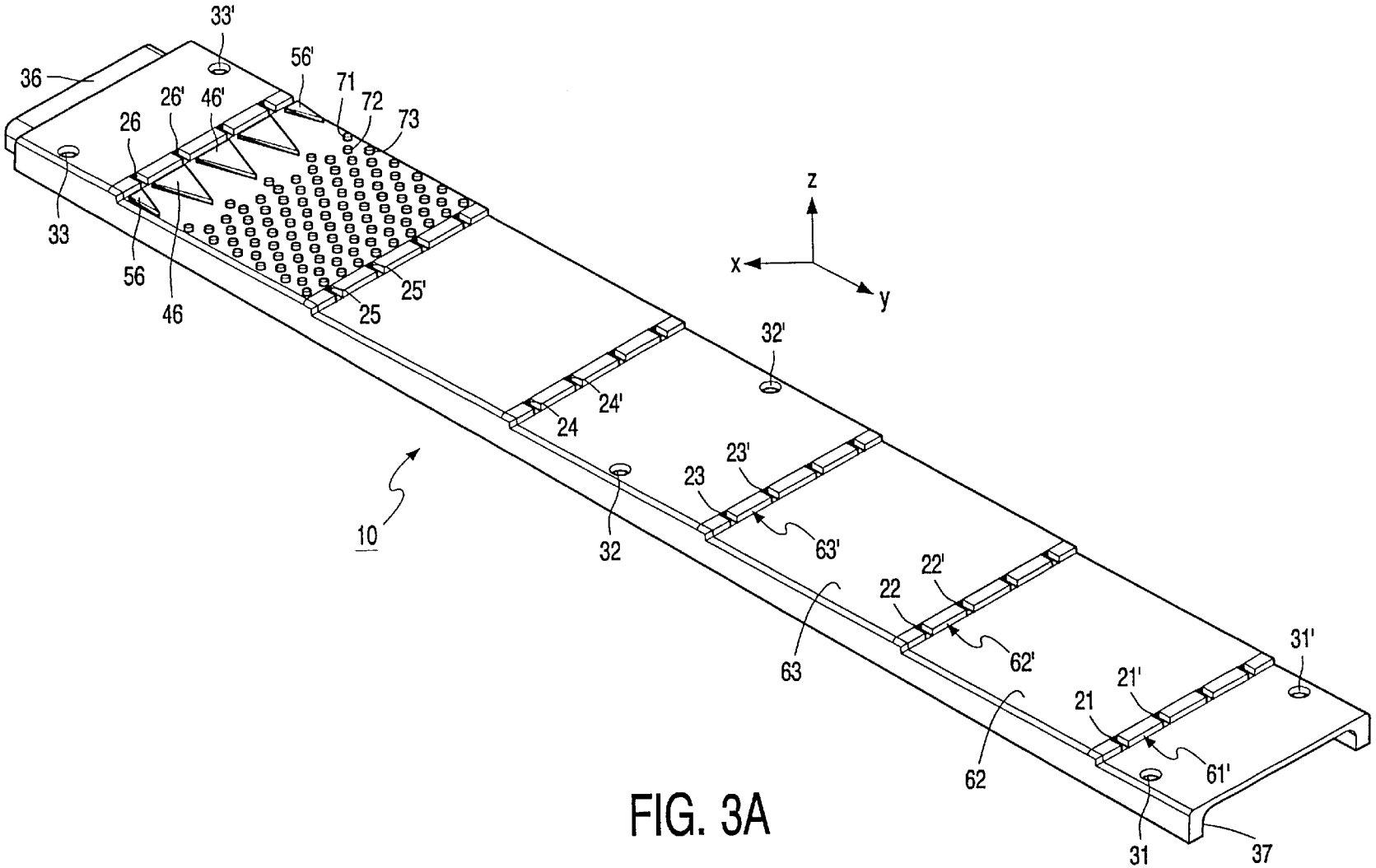
FIG. 3A is a perspective view of a second embodiment of the road-marking complex in accordance with the invention.
Figure 3B:
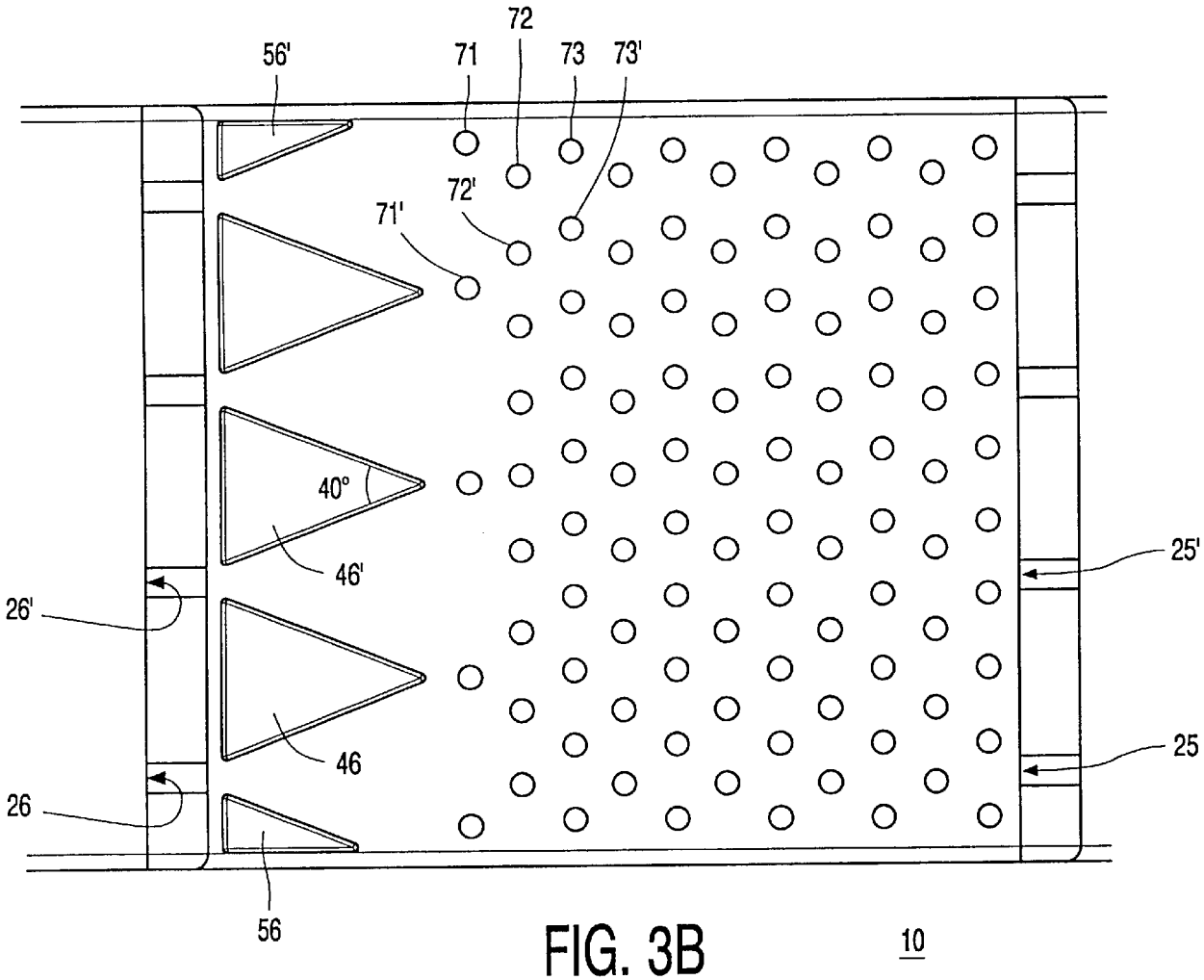
FIG. 3B is a plan view of a part of the second embodiment of the road-marking complex shown in FIG. 3A.

FIG 3A is a perspective view of a second embodiment of the road-marking complex in accordance with the invention, and FIG. 3B is a plan view of a part of the road-marking complex shown in FIG. 3A. In the embodiment shown in FIGS. 3A and 3B, a plurality of base plates of road-marking units form a solidly constructed base module 10. The base plates are not individually shown in FIG. 3A. The Figure clearly shows that six base plates 11, 12, as shown in FIG. 2, are joined so as to form the base module 10 shown in FIG. 3A. The base module 10 comprises a regular arrangement of 6×4 light sources 21, 21',22, 22',23, 23',24, 24', 25, 25', 26, 26'. For mounting purposes, the base module is further provided with screw openings 31, 31', 32, 32', 33, 33'. An end portion of the base module 10 is provided with a connection element 36, an opening 37 having a complementary shape being provided at the opposite end portion of the base module 10. Two base modules can be readily coupled via the connection element 36 in a first base module 10 and an opening in a second base module corresponding to the opening 37. At the upper side, the base module 10, as shown in FIG. 3A, is not a flat plate but a continuously obliquely ascending surface 62, 63 (at a angle of approximately 1.5°), a downward step 61', 62', 63' occurring at the location of the light source, whereafter the plate ascends again up to the next set of light sources. In this manner, the light sources are effectively protected from damage (for example caused by the wheels of a vehicle). To further protect the light sources, the base module is provided with (triangular) ascending guiding surfaces 46, 46', 56, 56' (see FIG. 3A and 3B; the apex of the triangles 46, 46, preferably is 40°) in the vicinity of the light sources 21, 21', 22, 22', 23, 23', 24, 24', 25, 25', 26, 26'. These ascending guiding surfaces 46, 46', 56, 56' make the transition from sloping surface 62, 63 to step 61', 62', 63' easier at the location of the light sources. For the sake of convenience, FIG. 3A shows only one set of ascending guiding surfaces 46, 46', 56, 56'. In the FIGS. 3A and 3B, a system of coordinates is provided for orientation purposes.

To increase the skid resistance, the base module shown in FIGS. 3A and 3B is at least partly provided with means for increasing the skid resistance of the base module. In this manner, a good contact between the wheels of a vehicle 6 and the surface of the road R is brought about under all kinds of weather conditions, and the risk of skidding is substantially reduced. Preferably, the means for increasing the skid resistance comprise a patteron of bumps 71, 71', 72, 72', 73, 73'. Preferably, said bumps do not all have the same height dimension. The skid resistance of the bumps is increased if the height dimension of the bumps in the rows 71, 71',73, 73' is greater than the height dimension of the bumps in the intermediate rows 72, 72'.

A particularly favorable embodiment of the road-marking complex in accordance with the invention is characterized in that the first and the second base plate, or the base module, are made of a material whose hardness is greater than or equal to 50 Shore D. In accordance with ISO-standard 868, the hardness of materials such as plastics and ebonite can be determined by means of a so-called durometer (also referred to as Shore scleroscope). In this method, the so-called height of rebound of a small hammer which is released from a certain height above the material is measured. A particularly suitable hardness of the material for use in the surface of a road is 75 Shore D. A particularly suitable material for the manufacture of the base module and the base plates of the road-marking complex is polyurethane.

In the embodiment shown in FIG. 3A and FIG. 3B, the base module 10 comprises a regular arrangement of 6×4 light sources 21, 21',22, 22', 23, 23', 24, 24', 25, 25', 26, 26', wherein always "rows" of six light sources 21, 22, 23, 24, 25, 26, 21', 22', 23', 24', 25', 26', arranged in line, are situated in the plane of the surface of the road R in the direction of view of the road users 5, and wherein always "rows" of four light sources 21, 21',22, 22', 23, 23',24, 24',25, 25',26, 26', arranged next to each other, are situated in the surface of the road R and transverse to the direction of view of the observer 5. Said rows of six light sources 21, 22, 23, 24, 25, 26, 21', 22', 23', 24', 25', 26', which are situated in the longitudinal direction of the field of observation of the road user, are spaced such that (in the example shown in FIGS. 3A and 3B at a mutual distance of approximately 16.6 cm), in operation, the light beams originating from these light sources, given the view angle of the road user 5, demonstrate a uniform overlap at a distance greater than or equal to 40 m. Said "rows" of four light sources 21, 21',22, 22',23, 23', 24, 24',25, 25',26, 26', which are arranged so as to extend transversely to the direction of view of the road user 5, are placed next to each other with so little space between them (in the example shown in FIGS. 3A and 3B at an interspace of approximately 3.75 cm) that the human eye cannot individually distinguish these light sources at a distance greater than or equal to 40 m.

A particularly favorable light source for use in the road-marking complex is formed by an end portion of an optical fiber. This has the advantage that the light emitted by the light source is generated in a light generator at a distance from the road-marking unit and is transferred from the light generator to the light source by means of optical fibers. Preferably, the optical fiber is provided with a lens at the location of the end portion (an example of a light source 221 forming an end portion of an optical fiber 285 provided with a lens 288 is shown in FIG. 6B). As the fibers are generally made of a synthetic resin, an accumulation of dust or other dirt at the location of the end portion can easily lead to a high heat development at the high luminous fluxes involved. The use of a lens made of glass precludes the fiber from becoming damaged by this heat development. The lens may be a simple cylindrically symmetric lens, but also an asymmetric lens can be advantageously used. An asymmetric lens enables the light beam emitted by the light source to be given the desired shape, thus enabling an energy-saving design to be applied.

Figure 4A:
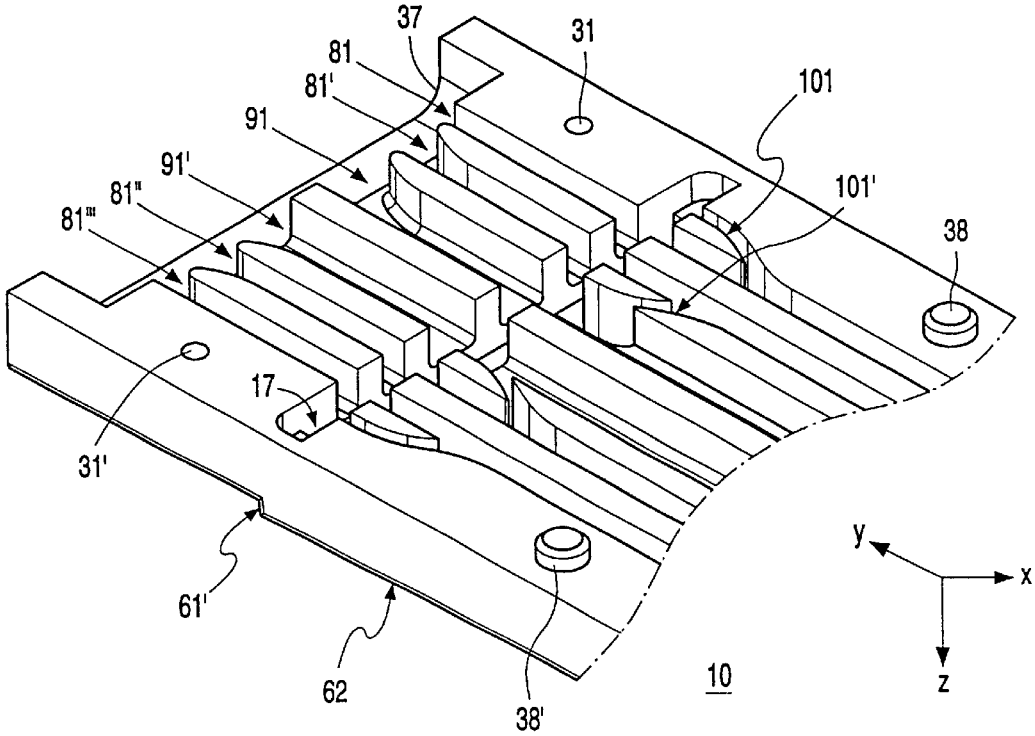
FIG. 4A is an embodiment of a part of the lower side of the base plate 10, provided with channels for accommodating cables for conducting electric current and/or light.

An embodiment of the road-marking complex in accordance with the invention is characterized in that the base module 10 is provided, on a side facing away from the light source, with channels 81, 81', 81", 81''', 91, 91', wherein cables are provided for conducting electric current and/or light. FIG. 4A shows an embodiment of a part of the bottom side of the base module 10 which is provided with channels 81, 81', 81", 81''', 91, 91" for providing light guides. After assembly of the fibers in the base module 10, said channels 81, 81', 81", 81''', 91, 91' of the base module 10 can be filled with a plastics material to improve the mechanical properties. The base module 10 is provided with screw openings 31, 31' (cf. FIG. 3A). The opening 37 in the base module 10 serves for interconnecting base modules (cf. FIG. 3A). The bottom side of the base module 10 is generally closed by means of a bottom plate (not shown in FIG. 4A), for which purpose the bottom side of the base module is provided with positioning and securing means 38, 38', which are known per se.

Figure 4B:
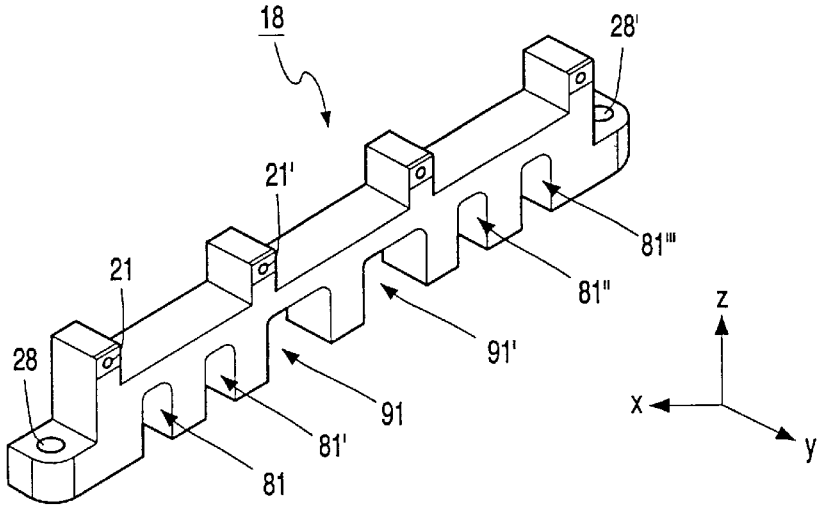
FIG. 4B shows an insertion comprising the end portions of the optical fibers, which fits in the embodiment shown in FIG. 4A.

FIG. 4A further shows the obliquely ascending surface 62 (at an angle of approximately 1.5°), a "downward" step 61' occurring at the location of the light sources, whereafter the plate "ascends" again up to the next set of light sources. At the location of the light sources, the bottom side of the base module 10 is provided with a recess 17 wherein an insertion 18 can be detachably secured by means of openings 28, 28'. Said insertion 18, which includes the end portions of the optical fibers, is shown in FIG. 4B, the orientation of parts being the same as that in FIG. 3A. For the sake of clarity, a co-ordinate system is shown in FIGS. 4A and 4B.

The insertions 18 are provided with the corresponding channels 81, 81', 81", 81''', 91, 91' wherein cables are provided for conducting electric current and/or light. In the example shown in FIGS. 4A and 4B, the channels 81, 81', 81", 81''' are used to provide optical light guides (not shown in FIG. 4B) whose end portions, which may or may not be provided with a lens, form the light sources 21, 21'. In the example shown in FIGS. 4A and 4B, the channels 91, 91' serve to feed through optical light guides from one base module to the next base module(s). The channel branches 101, 101' form recessed branches of the channels 81, 81', the end portions of the light guides being guided to the openings forming the light sources 21, 21'. The insertions 18 form, as it were, the base plates (11, 12) of the road-marking units (1, 2), as shown in FIG. 2. The insertions 18 are preferably made of polyurethane.

Figure 5A:
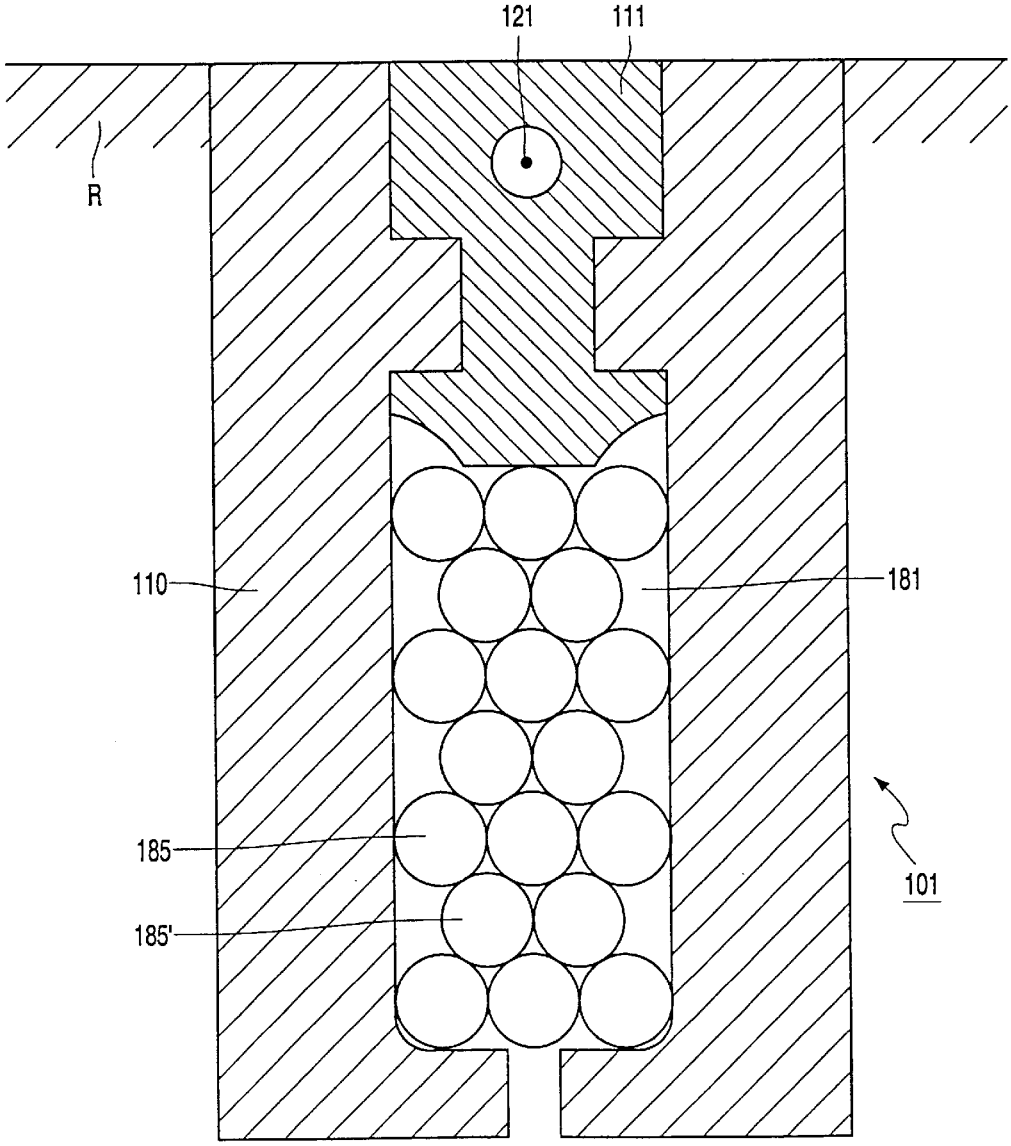
FIG. 5A is a cross-sectional view of a part of a third embodiment of the road-marking complex in accordance with the invention.
Figure 5B:
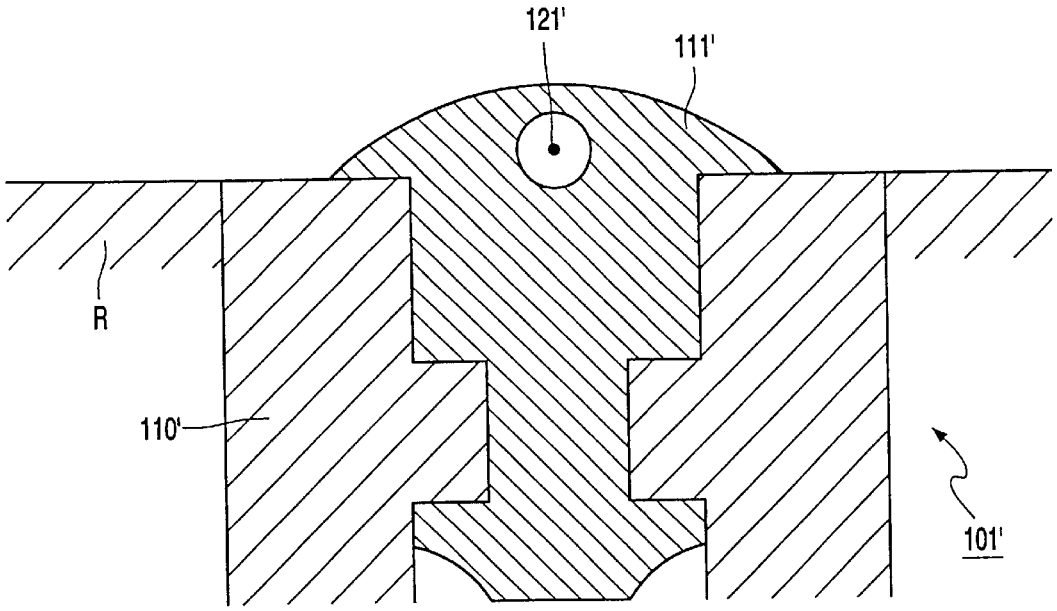
FIG. 5B is a cross-sectional view of a part of a fourth embodiment of the road-marking complex in accordance with the invention.

FIGS. 5A and 5B diagrammatically show a cross-sectional view of a part of a third embodiment (FIG. 5A) and a fourth embodiment (FIG. 5B) of the road-marking complex in accordance with the invention. In either case, only a first road-marking unit 101, 101' of the road-marking complex is shown. The road-marking unit 101, 101' is composed of a profiled holder 110, 110' wherein a base plate 111, 111' is secured which is provided with a light source 121, 121'. The base plate 111, 111' may be made from a synthetic resin or a metal. The profiled holder 110, 110', also referred to as luminaire profile, consists of a profiled strip which takes up relatively little space in the surface of the road R, so that this profile is protected, as good as possible, against wear and mechanical load, and, in addition, the surface of the road R provided with the holder 110, 110' meets the anti-skid requirements imposed on the surface of the road. The profiled holder 110, 110' is preferably also made of a synthetic resin, but may alternatively be made of concrete or asphalt or ZOAB (Zeer Open Asfalt Beton; in English: very open asphalt concrete).

In the case of dynamic road marking, four of these profiled holders 110; 110' are provided in a side-by-side relationship in the road surface R, so that lighting conditions comparable to those of the base module shown in FIG. 3A can be realized. In FIG. 5A, the light source 121 in the base plate 111 is apparently provided so as to be recessed in the road surface R, in FIG. 5B, a part of the base plate 111' provided with the light source 121' projects above the road surface R. In the example shown in FIG. 5A, the profiled holder 110 is provided with a channel 181 wherein cables 185, 185' are provided for conducting electric current and/or light.

Figure 6A:
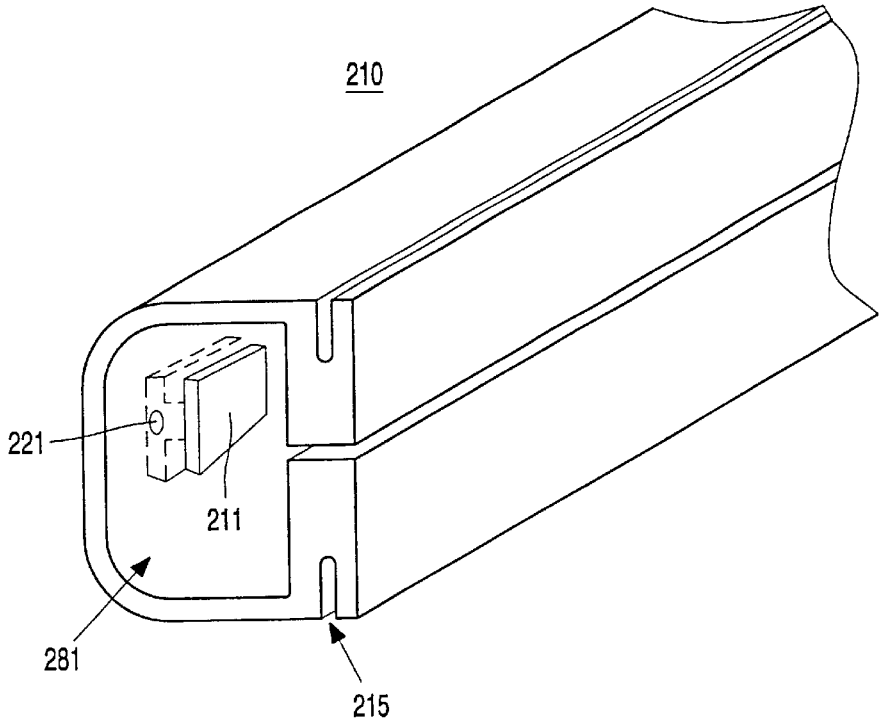
FIG. 6A is a perspective view of a fifth embodiment of the road-marking complex in accordance with the invention.
Figure 6B:
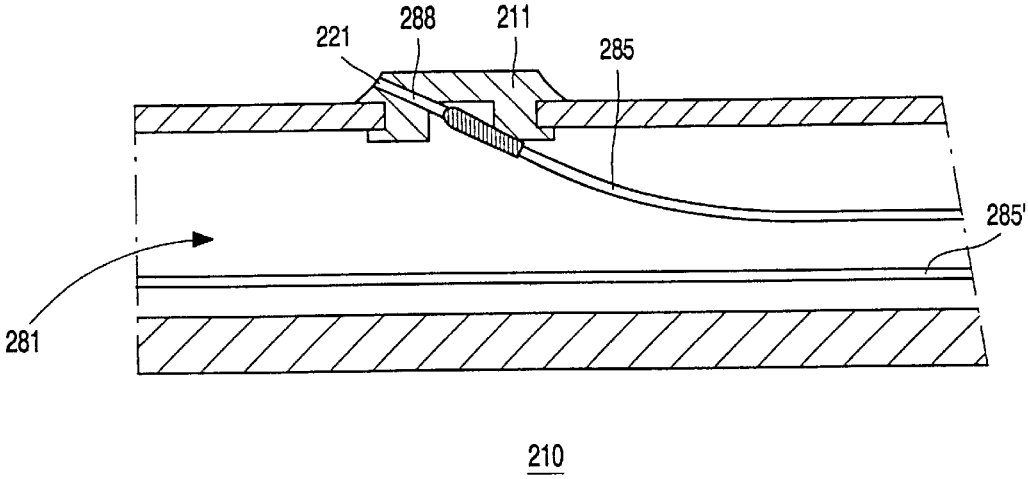
FIG. 6B is a cross-sectional view of a part of the road-marking complex shown in FIG. 6A.

FIG. 6A diagrammatically shows a perspective view of a fifth embodiment of the road-marking complex in accordance with the invention. The road-marking complex shown is particularly suitable for mounting on a crash barrier. In the example shown in FIG. 6A, a profiled holder 210 is provided with slots 215 for securing the holder 210 onto a mounting rail (not shown in FIG. 6A) which is provided on the crash barrier. The profiled holder 210 may be manufactured from various materials, such as rubber, thermoplastics, thermoplastic rubber (TPR) or metal. A holder made from rubber or TPR has the advantage that greater lengths of such holders can be rolled up. To manufacture the profiled holder 210, use is preferably made of an extrusion process which is known per se, and which enables great lengths of such holders to be made in a single run in a relatively short period of time. After the manufacture of the profiled holder 210, this holder is provided with openings which are provided at predetermined distances by means of a so-called punching process. In these openings there is provided a base plate 211 comprising a light source 221. In the example shown in FIG. 6A, the profiled holder 210 is provided with a channel 281 wherein cables are provided for conducting electric current and/or light.

FIG. 6B is a diagrammatic, cross-sectional view of a part of the road-marking complex shown in FIG. 6A. A light source 221 is provided in the base plate 211 which is provided in the profiled holder 210, which light source forms an end portion of an optical fiber 285 provided with a lens 288. A plurality of such optical fibers 285, 285' is guided through the channel 281.

Figure 7:
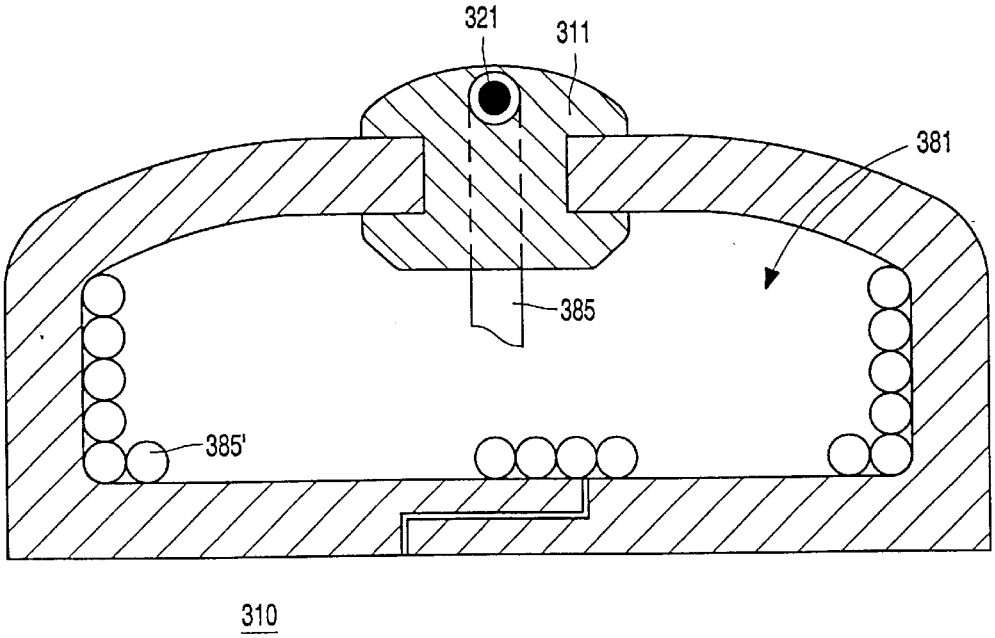
FIG. 7 is a cross-sectional view of a sixth embodiment of the road-marking complex in accordance with the invention.

FIG. 7 is a diagrammatic, cross-sectional view of a sixth embodiment of the road-marking complex in accordance with the invention. The road-marking complex shown is an alternative embodiment of the road-marking complex shown in FIGS. 6A and 6B and can particularly suitably be used for mounting on a crash barrier. In the example shown in FIG. 7, a base plate 311 provided with a light source 321 is arranged in a profiled holder 310. The light source 321 forms an end portion of an optical fiber 385 (diagrammatically shown in FIG. 7). The profiled holder 310 is further provided with a channel 381 through which a plurality of optical fibers 385, 385' are guided.

Figure 8:
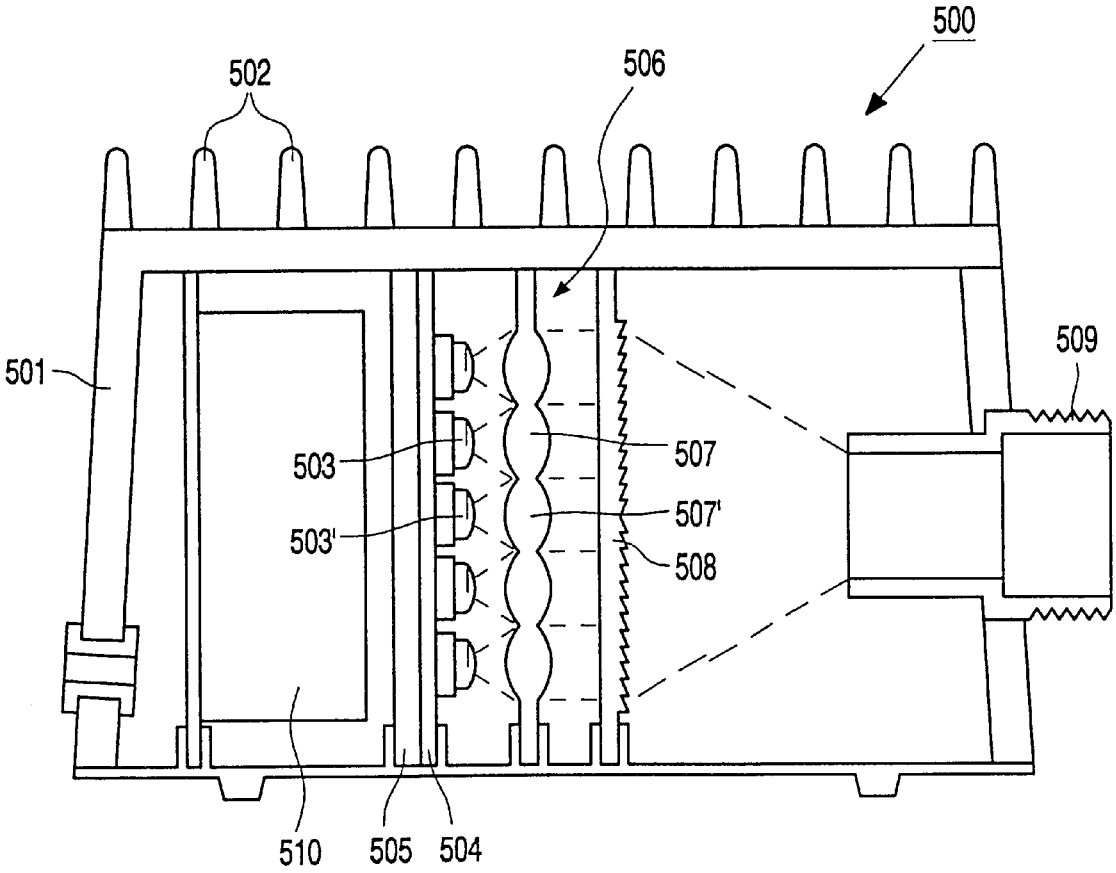
FIG. 8 is a cross-sectional view of an embodiment of the light generator in accordance with the invention.

FIG. 8 shows an embodiment of the light generator in accordance with the invention. The light generator 500 comprises a metal housing 501 which is provided with metal cooling fins 502. In this example, the housing 501 and the cooling fins 502 are made of aluminium, and the overall dimensions of the housing 501 are 11 cm by 9 cm by 8 cm.

The housing 501 accommodates a light source in the form of a plurality of opto-electronic elements, which, in the example of FIG. 8, are 12 light-emitting diodes (LEDs) 503, 503', which are mounted on a so-called MC-PCB 504 (metal-core Printed Circuit Board). The MC-PCB 504 is provided on a metal (aluminium) plate 505, for example by bonding using a heat-conducting adhesive. The metal plate 505 is in heat-conducting contact with the housing 501. This construction enables the heat generated by the LEDs 503, 503' to be dissipated to the surroundings via the MC-PCB 504, the metal plate 505 and the housing 501 with the cooling fins 502.

In a particularly favorable embodiment, a combination of red and green LEDs of the type "Barracuda" (Hewlett Packard) is used. The luminous flux per LED is ≧ 10 lm (red LEDs) and ≧ 13 lm (green LEDs). The use of these "high-efficiency, high-output LEDs" has the advantage that the number of LEDs can be relatively small at a desired, relatively high luminous efficacy. This results in a greater compactness of the generators to be manufactured.

The housing 501 also comprises an optical system for directing the radiation generated by the LEDs. This optical system comprises a collimator lens 506, which is composed of twelve sub-lenses 507, 507' which are pressed in an optically transparent synthetic resin (PMMA). Each of the twelve sub-lenses 507, 507' matches one of the twelve LEDs 503, 503', and collimates the radiation from said LED. The optical system also comprises a focusing lens 508 which, in this preferred embodiment, is embodied so as to be a Fresnel lens. By means of a focusing lens 508, the collimated radiation from the LEDs is focused at one point. For the sake of clarity, the passage of the light rays generated by the LEDs 503, 503' through the optical system is indicated very diagrammatically.

The housing 501 is further provided with a coupling sleeve 509 to which a light guide or a beam of light guides (optical fibers) can be detachably connected. It is emphasized that the current invention is not limited to this application.

The housing 501 is also provided with control electronics which is necessary to operate the LEDs. In the present case, the control electronics is accommodated in a box 510 in the housing 501. It is noted that the control electronics may optionally be located outside the housing 501.

It will be obvious that within the scope of the invention many variations are possible to those skilled in the art.

The scope of protection of the invention is not limited to the above examples. The invention is embodied in each new characteristic and each combination of characteristics. Reference numerals in the claims do not limit the scope of protection thereof. The use of the term "comprising" does not exclude the presence of elements other than those stated in the claims. The use of the term "a" or "an" in front of an element does not exclude the presence of a plurality of such elements.

What is claimed is:

1. A road-marking complex comprising a first road marking unit and a second road-marking unit wherein the first road-marking unit comprises a first base plate which is provided with a first light source, and the second road-marking unit comprises a second base plate which is provided with a second light source, and, between an angle of 0.1 to 8° with a line connecting the first light source to the second light source, light beams originating from the first light source and the second light source demonstrate a uniform overlap at a distance "a" from the first light source, where the distance a≧40 m.

2. A road-marking complex as claimed in claim 1, further comprising a light generator having a housing which accommodates the first light source as well as an optical system for directing radiation generated by the first light source, said first light source comprising a plurality of opto-electronic elements, and said light generator being provided with control electronics for operating the opto-electronic elements.

3. A road-marking complex as claimed in claim 2, characterized in that the optical system comprises a collimator lens with a number of sub-lenses, a first optical axis of each of the sub-lenses coinciding with a second optical axis of one of the opto-electronic elements, and in that the optical system also comprises a focusing lens.

4. A road-marking complex as claimed in claim 3, characterized in that the focusing lens is a Fresnel lens.

5. A road-marking complex as claimed in claim 2, characterized in that the opto-electronic elements comprise light-emitting diodes whose luminous flux during operation is at least 5 lm.

6. A road-marking complex as claimed in claim 1 wherein the first base plate and the second base plate form a solidly constructed base module.

7. A road-marking complex as claimed in claim 6, characterized in that the base module comprises a pattern of bumps for increasing a skid resistance of the base module.

8. A road-marking complex as claimed in claim 6, characterized in that the base module comprises ascending guiding surfaces in a vicinity of the first and second light sources, for protecting the first and second light sources.

9. A road-marking complex as claimed in claim 6, characterized in that the base module comprises, on a side facing away from each said light source, channels wherein cables are provided for conducting electric current and/or light.

10. A road-marking complex as claimed in claim 1 wherein each said light source forms an end portion of an optical fiber.

11. A road-marking complex as claimed in claim 10, characterized in that the optical fiber is provided with a lens at the end portion.

12. A road-marking complex as claimed in claim 1 wherein the first light source and the second light source are separated by a distance "d" in the range from $10 \leqq d \leqq 25$ cm.

13. A road-marking complex as claimed in claim 1, characterized in that the first base plate and the second base plate are made of a material whose hardness is greater than or equal to 50 Shore D.

14. A road-marking complex as claimed in claim 1 wherein the first road-marking unit comprises, on a side facing away from the first light source, channels wherein cables are provided for conducting electric current and/or light.

15. A road-marking complex as claimed in claim 1 wherein the first base plate and the second base plate are comprised of polyurethane.

16. A road-marking complex as claimed in claim 1 wherein the first light source is recessed in the first base plate, and the second light source is recessed in the second base plate.

17. A road-marking complex as claimed in claim 1 wherein each said light source comprises an opto-electronic element, a luminous flux of the opto-electronic element amounting at least to 5 lm during operation.

18. A road-marking complex as claimed in claim 1 further comprising a light generator situated at a distance from the first light source.

19. A road surface provided with a road-marking complex as claimed in claim 1.

20. A system for marking roads comprising one or more road-marking complexes as claimed in claim 1 or 2, a control system for the one or more road-marking complexes and means for coupling the one or more road-marking complexes to the control system.

* * * * *